US007160234B2

(12) United States Patent
Dise

(10) Patent No.: US 7,160,234 B2
(45) Date of Patent: Jan. 9, 2007

(54) EXERCISE MACHINE

(76) Inventor: David Dise, 710 Farnham Dr., Richmond, VA (US) 23236

( * ) Notice: Subject to any disclaimer, the term of this patent is extended or adjusted under 35 U.S.C. 154(b) by 429 days.

(21) Appl. No.: 10/189,186

(22) Filed: Jul. 5, 2002

(65) Prior Publication Data

US 2003/0017923 A1 Jan. 23, 2003

(51) Int. Cl.
*A63B 26/00* (2006.01)

(52) U.S. Cl. ..... 482/142; 482/907

(58) Field of Classification Search ..... 482/142, 482/148, 907, 91; D21/676, 686, 662, 690
See application file for complete search history.

(56) References Cited

U.S. PATENT DOCUMENTS

| | | | | |
|---|---|---|---|---|
| 4,207,879 | A * | 6/1980 | Safadago et al. | 606/242 |
| 4,647,040 | A * | 3/1987 | Ehrenfried | 482/131 |
| 4,720,099 | A * | 1/1988 | Carlson | 482/133 |
| 5,137,504 | A * | 8/1992 | Mangini | 182/131 |
| 5,277,681 | A * | 1/1994 | Holt | 482/112 |
| 5,904,641 | A * | 5/1999 | Huang | 482/131 |
| 6,090,022 | A * | 7/2000 | Colecchi | 482/131 |
| 6,352,495 | B1 * | 3/2002 | Hsu | 482/92 |

* cited by examiner

*Primary Examiner*—Lori Amerson
(74) *Attorney, Agent, or Firm*—Whitham, Curtis, Christofferson & Cook, P

(57) ABSTRACT

A stretch therapy apparatus provides for enhanced physical fitness as well as rehabilitation and medical treatment by allowing the user to increase core flexibility and shoulder flexion. The stretch therapy apparatus includes both a hip locking mechanism that retains the user's hips securely so that he or she may than rotate about his or her spine to grasp a grip (i.e., handle, vertical pole, etc.) located outside the opposite hip and preferably located behind the user's opposite shoulder prior to beginning the stretch. One embodiment of the hip locking mechanism allows the user to easily and safely separate his or her legs by 180 degrees or more using a hand crank or motorized mechanism. Alternatively, the hips and pelvis may be locked in place by the legs being restrained and the hips pushed against an object such as the back of a chair. For core flexibility enhancement, preferably the grip is moveable to varying locations so that increases in the user's flexibility can be realized and positive feedback can be provided. A series of grips may also be used whereby progress is charted by being able to reach to further and further grips. Resistance training may also be employed wherein the grip may be affixed to a weight stack for either pulling the user's arm across his or her chest, or the weight stack can be lifted after achieving the stretch. For shoulder flexion enhancement, the user will grasp a grip located on the same side of his or her body and lift the user's elbow towards vertical.

38 Claims, 12 Drawing Sheets

EXERCISE MACHINE

BACKGROUND OF THE INVENTION

1. Field of the Invention

The present invention generally relates to a stretching machine and, more particularly, to a machine for stretching of the back and shoulders.

2. Description of the Related Art

Stretching prior to commencing any exercise regimen is of paramount importance to reduce the likelihood of exercise related injuries. It is important that stretching be carried out with smooth continuous movements, rather than with bouncy movements, in order to avoid injuries during the stretching exercise itself. Ideally, the muscles should be in a relaxed state to maximize the stretch and to avoid undue stress on the muscle, tendons and skeleton.

Stretching is also an important part of any physical therapy regimen practiced by patients undergoing physical rehabilitation following an accident, an illness or those seeking relief from common ailments as back pain. This type of therapy is commonly supervised by a highly trained physical therapist in a hospital setting or perhaps in the patient's home. A therapist may, if needed, maneuver the patient's limbs through a full range of motion being careful not to force or over stretch the muscles. The therapist must exercise even greater care and supervision if the patient is using a machine to stretch since a wrong machine setting or a patient who is unaware of his/her thresholds may easily over stretch and be injured.

Stretching techniques and exercises help in several key areas. Stretching may help to avoid injury, it may enhance athletic or functional performance and stretching assists in situations where scar tissue is present such as after an injury, surgery or from aging. With a great percentage of the populous going beyond middle age, stretching and flexibility is becoming more important every day.

Traditionally, pre-exercise, post-exercise, as well as therapeutic stretching is done on a floor mat or while standing. In a typical floor stretching exercise, a person lays on his back with his arms stretched out perpendicular to his body. Keeping his shoulders against the ground, the hips are rotated while one leg is brought to touch the ground on the opposite side of the person's body stretching the lower back. This stretch is then repeated on the other leg to achieve balanced flexibility.

Another stretch which is particularly used by golfers involves threading a golf club behind the back but in front of the elbows. Then while standing with legs shoulder width apart, the person will rotate their upper body left and right while keeping their feet firmly planted on the ground. This exercise is to increase a so-called "X Factor" or "Core flexibility," which is the difference in the relative rotation of the hips and the shoulders while making a swinging motion. By increasing the relative difference in rotation, it is believed to impart a whip-like effect to any motion which involves the rotation of the back. As mentioned in "The X-Factor Stretch" in Golf Magazine March, 2001 the concept of an X factor was introduced in 1992 and now is a widely used method to increase the power in a golfer's swing.

In the design and manufacture of exercise and stretching machines there has recently been movement away from using resistance while stretching or exercising the back. When too much resistance or too much external force is used in rotating the back, lower back or spine injury can occur. Having a machine that would provide the means of stretching the back without the risk of injury would aid in increasing flexibility while keeping the user safe.

Currently there are stretching and exercise machines that secure the hips and pelvis, while the upper torso undergoes strength training.

U.S. Pat. No. 4,678,186 to McIntyre, et al. shows an improved pelvic restraint being provided for use in association with an exercise apparatus which is most suitably a low back exercise apparatus. The pelvic restraint comprises a seat having laterally adjustable hip restraints provided with a belt for extending there between across the abdomen of a user. An adjustable back restraint is also provided for engagement with the lower back. In this fashion, the pelvic restraint prevents lifting or lateral shifting of the hips and forward or rearward pitching of the pelvic area so that more accurate evaluation may be conducted on an exercise apparatus to which the pelvic restraint is secured. While McIntyre provides for the securement of the pelvis, rotational static stretching requires several other attachments.

U.S. Pat. No. 4,893,808 to McIntyre, et al. shows a neck exercising device that allows the user to move his neck in several dimensions against a predetermined resistance. The hips and the pelvis are secured from rotation or movement. However, this device only allows exercise of the neck even though the hips and pelvis are secured.

U.S. Pat. No. 5,110,121 to Foster shows an exercise chair specifically designed to be usable as an ordinary office chair or as a device for exercising the muscles of the lower back. The chair employs both anterior and posterior pelvic restraints to prevent rotation of the pelvic region during an exercise routine. However, Foster does not allow for static stretching for the torso.

U.S. Pat. No. 5,277,681 to Holt shows a leg spreading device which is used for several stretching exercises. One such exercise, involves the securement of the legs to prevent pelvic rotation while the upper torso is rotated by a surrounding frame being moved by hydraulic cylinders. This arrangement does not, however, allow for static, free stretching under the user's own power.

U.S. Pat. No. 5,288,130 to Foster shows a chair specifically designed to be usable as an ordinary office chair. The chair employs both anterior and posterior pelvic restraints to prevent rotation of the pelvic region. Several adjustment devices permit proper movement up and down and back and forward of the arm rests so that they may be used as anterior pelvic restraints during exercise. However, this chair provides no device or attachments for rotational stretching.

These patents as well as U.S. Pat. No. 5,626,547 to Davies, III et al., U.S. Pat. No. 5,529,560 to Davies, III et al., U.S. Pat. No. 5,421,801 to Davies, III et al. and U.S. Pat. No. 5,938,573 to Davies, III et al. all show a device that has a leg spreader and forwardly positioned pole for stretching a user's back muscles.

SUMMARY OF THE INVENTION

It is an object of this invention to provide a stretch therapy apparatus useful for physical fitness, rehabilitation, medical treatment and testing.

It is an object of this invention to provide an improved stretching machine that allows a wide variety of different stretches to be performed safely, and particularly stretches that enhance core flexibility.

It is another object of this invention to provide a stretching machine which can be used for arm, back, and other muscle stretching wherein the different muscles can be stretched individually or together in a coordinated fashion. These muscles include but are not limited to the external abdominal oblique and internal abdominal oblique muscles, the rectus abdominis, the transverse abdominis, the latissmus dorsi, and the longissimus, spinalis and lliocostalis muscles. In addition, it is an object of this invention to provide a stretching machine that can be used for shoulder flexibility enhancement and rehabilitation which can be used to stretch the deltoids, humerus, teres, latissimus and infraspinatus muscles.

It is another object this invention to provide a stretching machine which provides a hip securement to maximize the stretching effects of rotating the upper torso.

It is another object of this invention to provide a stretching machine which provides positive feed-back relating to the progress of the user. In particular, it is an object to provide a machine where a user's core flexibility can be measured and progress towards and enhanced flexibility can be readily ascertained from increased rotational movement towards more distant gripping members or increased movement of a moveable grip member.

It is yet another object of this invention to provide a way of measuring and exercising the posterior rotation of the shoulder.

According to the invention, a stretch therapy apparatus provides a safe and effective means for stretching the torso while the user is in a seated position. The mechanism used for rotational stretching is adjustable and can also be used for stretches or exercises which involve reaching to either side of the body or behind the shoulders. One objective of the stretch therapy apparatus is to increase a user's rotational core flexibility. The torso stretch is made more efficient by the inclusion of a pair of leg decks, leg restraints or other pelvic restraining methods, which lock the hips in a single position. Indicia are provided for positive feedback to the user, as well as to provide a trainer or therapist with stretching assessment information. The machine may also be used to measure shoulder flexion and rotation by indica included on the machine.

By use of the described stretch therapy apparatus, the user is forced to use proper technique while stretching which minimizes risk of injury. Also, by using the described stretch therapy apparatus, the user is able to relax while in a stretching position and accomplish an assisted stretch (which normally requires two people). Stretching is performed without the user being required to support his or her weight. Stretching can proceed beyond the user's normal range of motion, and is followed by relaxation, and possibly further stretching. In this way, the user may possibly extend his or her range of motion. Indica are provided on the apparatus to allow determining the user's flexibility, and to allow the user to set goals and track progress in a stretching or exercise regimen.

An important stretching exercise is accomplished by the user sitting in a seat with his hips and pelvis secured from movement or rotation. Then, the user reaches with one hand and grasps a grip (e.g. a handle or bar) that is positioned outside the user's opposite hip. Preferably, the grip is positioned at or moveable to a point that would be behind the opposite shoulder prior to rotation. Thus, in operation the user rotates his or her body about the spine, he or she will grasp a grip and hold onto the grip for a period of time to achieve an assisted stretch. The user's shoulders will be permitted to rotate freely in order to for the user to reach for and grasp the grip, thereby allowing and enhancing the type of rotation used in golf, tennis and other sports. Once resistance or tightness is felt in the rotated torso, the user is to hold the stretch for a set amount of time. This stretch should be done on the both sides of the body to provide balanced flexibility. The user may also pull on the grip while his or her torso is in rotation to enhance the stretch.

In separate embodiments of the invention, the grip may be a single pair of handles adjustable in several planar and rotational dimensions or an array of handles that are positioned at different degrees of rotation to reach.

Another stretch facilitated by the described apparatus pertains to shoulder flexion. While the user is seated in the apparatus, the upper arm is raised to be perpendicular to the torso and then the forearm is rotated until it is as near to being vertical as possible for the user while the user's hand holds onto a grip. This aids in rehabilitating shoulder muscles and provides for increased flexibility.

BRIEF DESCRIPTION OF THE DRAWINGS

The foregoing and other objects, aspects and advantages will be better understood from the following detailed description of the preferred embodiments of the invention with reference to the drawings, in which.

DETAILED DESCRIPTION OF THE PREFERRED EMBODIMENTS OF THE INVENTION

Figure 1:
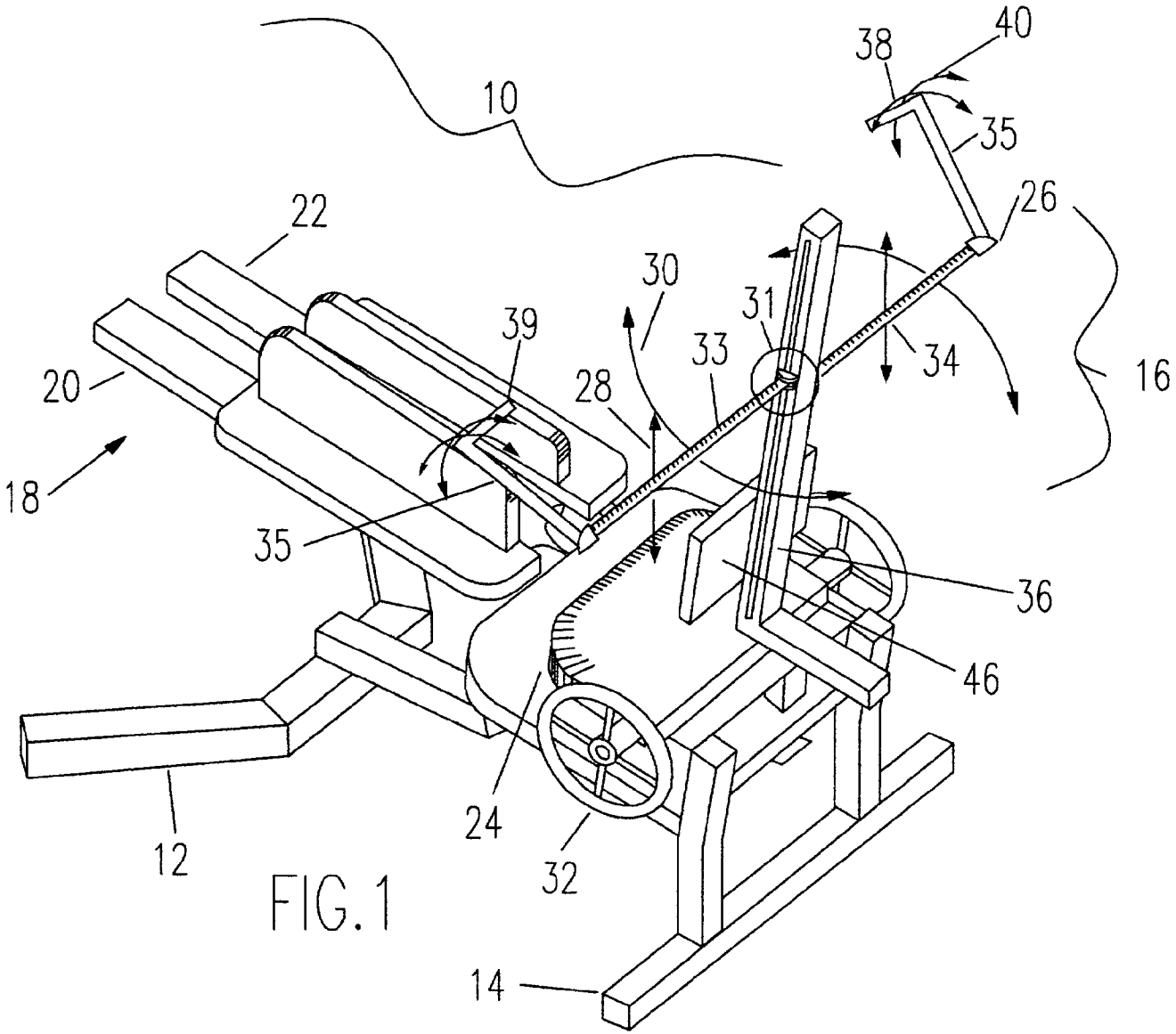
FIG. 1 is an isometric view of one embodiment of the stretching machine or "stretch therapy apparatus" according to the invention.

Referring now to the drawings, and more particularly to FIG. 1, there is shown an isometric view of the stretching machine generally referred to by the reference numeral 10. The support frame of the stretching machine includes front 12 and rear 14 support members which are preferably made from tubular steel or similar sturdy material. In the preferred embodiment, the stretching machine includes both a back and arm stretching component 16 and a leg, thigh, and calf stretching component 18. The leg, thigh, and calf stretching component 18 preferably includes a pair of leg supports, 20 and 22, projecting outward from a seat 24. Leg supports 20 and 22 have a range of motion so that they may be spread from 0 degrees apart to 180 degrees apart. This complete range preferably is provided so that any user, regardless of flexibility in the thigh and groin area, may be able to secure their hips. In the embodiment shown in FIG. 1, he back and arm stretching component 16 projects from beneath seat 24, behind the user. An important requirement for core flexibility enhancement is to provide a means for the user to rotate about his or her spine and hold onto a grip positioned outside the hip opposite of his or her hand used to achieve the stretch. In FIG. 1, the stretch is achieved by grasping a handle 35 on one side of the body with the user's hand on the opposite of the body after rotation about the spine. It should be understood that core flexibility enhancement may also be achieved if the handle 35 were located outside of the leg supports 20 and 22. The back and arm stretching component 16 preferably includes a hinge mechanism 26 which allows the user to set the handles 35 to any orientation to maximize the stretching exercises or to give an indication of distance rotated as shown by arrows 40. In addition, the back and arm stretching components 33 and 34 can be pivoted or moved to any angular and vertical orientation with respect to the user's waist as shown by arrows 30 and 28 by hinge mechanism 31. This allows accommodating users of different sizes, shapes, and intrinsic flexibilities. The leg supports, 20 and 22, open and close in a jaw-like fashion to effectively open and secure a user's hips.

In one embodiment of the invention, the legs, back and calf stretching component 18 may be similar or identical to that described in U.S. Pat. No. 5,626,547 to Davies, III et al., U.S. Pat. No. 5,529,560 to Davies, III et al., U.S. Pat. No. 5,421,801 to Davies, III et al. and U.S. Pat. No. 5,938,573 to Davies, III et al., each of which are herein incorporated by reference.

A principal objective of this invention is to secure the user's hips so the stretch being performed is as efficient as possible. In order to accomplish this, a user's hips must be prevented from twisting and turning during rotation of the upper torso. When the hips are secure, the user may safely and efficiently stretch his or her back and torso muscles by reaching across his or her body to a handle 35 on the opposite side of the reaching hand and then hold his or her body in rotation. This stretch can be enhanced by pulling against the handle once it is gripped. In the FIG. 1 embodiment, leg supports 20 and 22 accomplish this goal by spreading the user's legs until gentle pressure from the legs oppose spreading the legs any further. The leg supports, 20 and 22, can be moved either under the power of a user's legs, or by a mechanical mechanism such as, for example, a manual or motorized crank, gear and pulley arrangement 32. Once this is accomplished, the hips can be considered secured. However, it should be understood that other mechanisms for securing the user's hips may be also employed. For example, any mechanism which holds a user's hips squarely against a wall, chair or other support would be a suitable means for restraining the movement of a user's hips.

Still referring to FIG. 1, an adjustable back-rest 46 is preferably provided for providing upper and lower lumber support for a user. However, it is preferred that the back-rest 46 be of a size and set at a height which permits the user to rotate his or her shoulders about the spine in order for the user to reach further around the spine to the handle 35 on the opposite side of his or her body. The attitude of the seat 24 can also be adjusted as required for certain exercises. This may be accomplished either by changing the attitude of the seat 24 with respect to the machine 10, or by adjusting the height of either the front 12 or rear 14 support to change the angle of the entire machine 10 and thereby increase the gravity effect on the exercise.

Handles 38 and 39 can be provided, and are preferably used to measure or exercise the user's shoulders flexion and rotation while the user is seated in seat 24. To accomplish this, the user's hand is brought up so that the upper arm is parallel to the ground and forearm is parallel to the ground as well as perpendicular to the upper arm. The user does not reach across his or her body for this exercise. While seated in seat 24, the user grasps either grip 38 or 39, depending which shoulder the user is measuring, and rotates his forearm as far to a vertical position as possible. In a preferred embodiment, the motion of 38 and 39 is ratcheted so that a user may ascertain how far back his or her shoulder was rotated.

Figure 2:
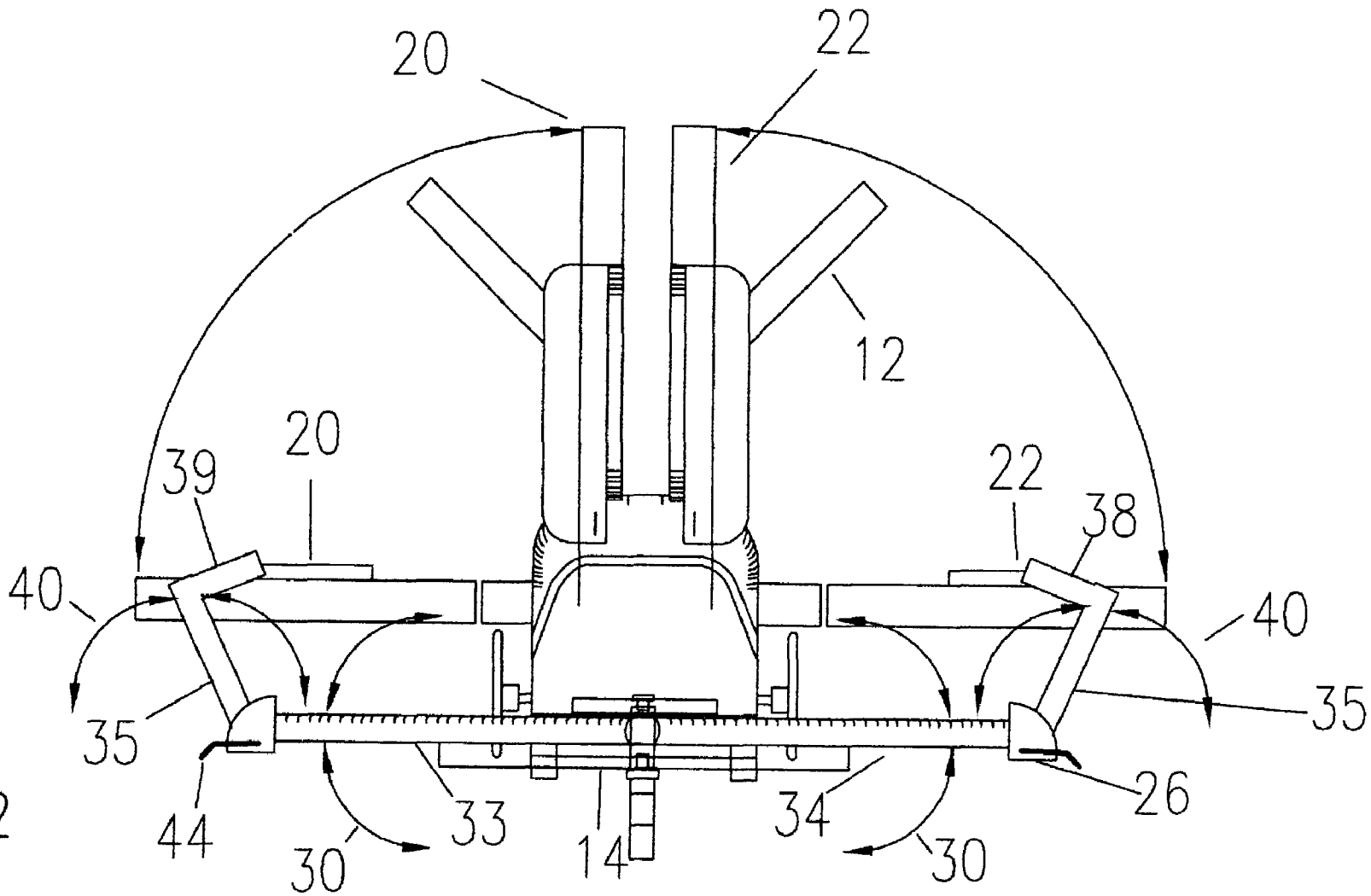
FIG. 2 is a top view of the stretching machine shown in FIG. 1.

Referring now to FIG. 2, the machine 10 is shown in its open configuration illustrating the complete range of horizontal motion. The back and arm stretching component 16 includes an adjustable support beam 33 and 34, which can be adjusted as shown by arrows 28 and 30. The handles may take multiple forms, for example, a pole adjustable along the length of the support beam (80 in FIG. 5), rubber or velcro strips or an end mounted handle 35, which is adjustable by hinge 26 which provides a ratchet mechanism to limit the movement of handle 35 to one direction. The handlebar 35 is rotatable for particular exercises and can achieve orientations between perpendicular to the pole or parallel with the pole as shown by arrow 40.

In operation, the user sits in the seat 24 and selects a particular pole orientation for the back and arm stretching component 16. The user initially secures their hips by cranking the leg supports 20 and 22 so gentle tension is felt in the legs. Then, the user may reach around and grasp handle 35 on the opposite side of the body and push it away from the body. Resistance may be added if desired to oppose the user's movements. A rachet mechanism 26 may be used which permits movement in only one direction. This allows the user to achieve an assisted stretch by using the handle 35 to rotate his or her body, while the machine 10 holds the user in a stretched position for any desired period of time. The rachet mechanism 26 may be designed to click at specific intervals, such as, for example, every centimeter. Indicia can be provided on hinge 26 to provide accurate flexibility measurement and positive feedback regarding the distance of the stretch. This allows a patient's progress to be monitored, and allows a user to self monitor his or her progress. Since the user is stretching on his or her own initiative and not under the influence of some outside force, there is no danger of muscle hyper-extension or other stretching related injury. A release lever 44 is provided to release the rachet mechanism 26 so that the handlebars 35 can be reset for another exercise repetition.

Figure 3:
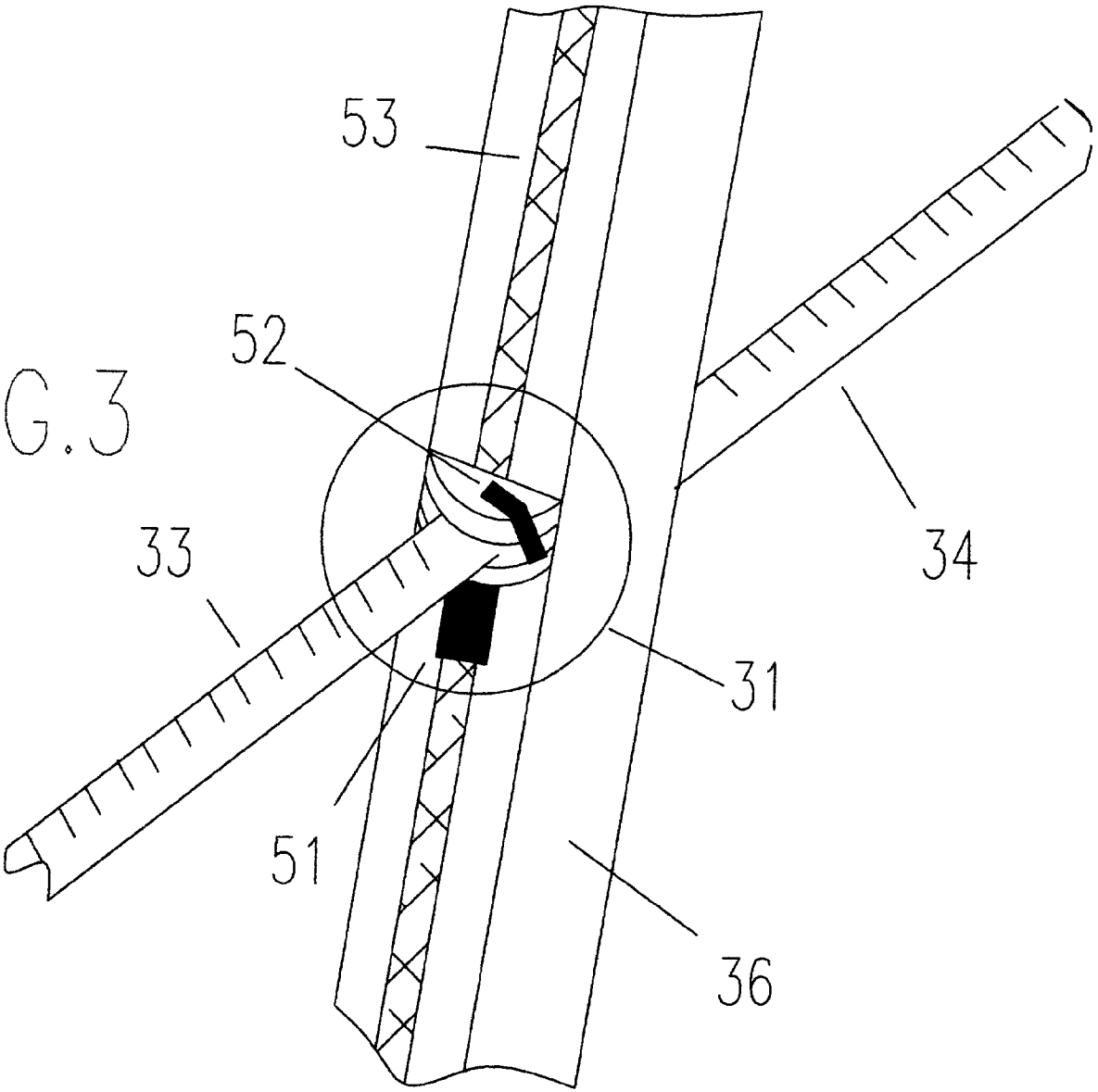
FIG. 3 is an exploded isometric view of one embodiment of a main hinge and support mechanism.

FIG. 3 shows an expanded view of one configuration for a hinge mechanism collectively referred to as 31. The mechanism controls the vertical and angular movement of support beams 33 and 34 in relation to beam 36. On either side of 36 are grooves 53 which guide the vertical motion of 33 and 34. Mechanism 51 limits the unopposed vertical movement of 33 and 34 to up, and when a downward adjustment is necessary, 51 is merely released. Mechanism 52 secures the angular motion of 33 and 34 while using the stretching device.

Figure 4:
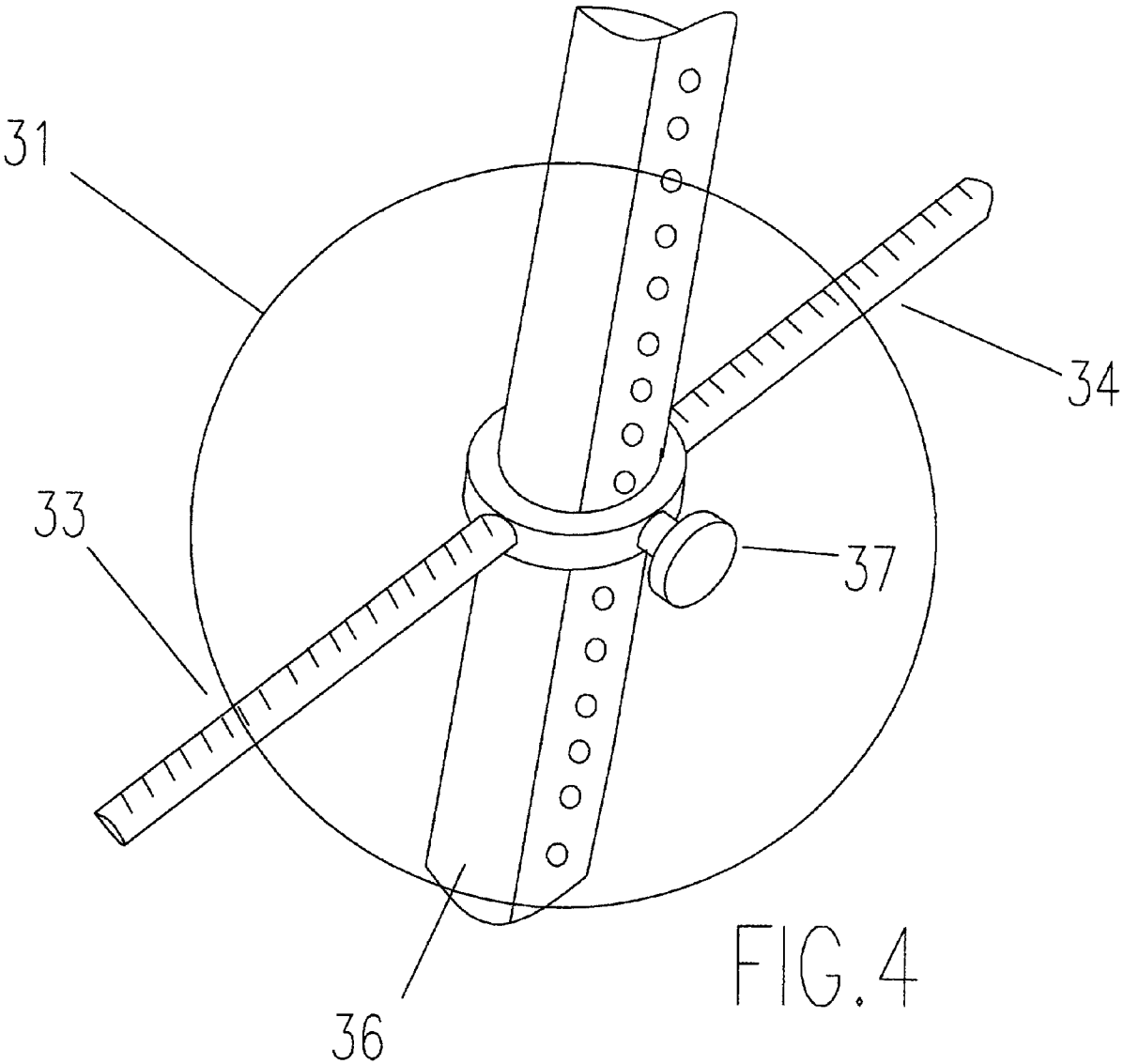
FIG. 4 is an exploded isometric view of an alternate main hinge and support mechanism.

FIG. 4 shows an alternate embodiment of the hinge mechanism 31 where locking mechanism 52 (FIG. 3) is eliminated and the function of mechanism 51 is replaced by locking pin mechanism 37. Locking pin mechanism 37 secures support bars 33 and 34 by using a retractable pin to secure the vertical motion of the bars and allows support bars 33 and 34 to be rotated angularly. A wide variety of mechanisms other than those shown in FIGS. 3 and 4 may be used in the practice of this invention. The objective would be to have a grip which is positionable at a location outside the user's opposite hip from his or her gripping hand so that the user can rotate his or her shoulders about his or her spine and grasp a handle for holding a stretch. Preferably, the handle would be positioned at or moveable to a location that would normally be behind the user's opposite shoulder prior to beginning the stretch. In addition, it is preferable to have the handle rigidly placed so that the user may have is or her weight supported while stretching and so that the user may pull against the handle to enhance the stretch. As will be discussed in more detail in conjunction with FIG. 12, the handle might also be combined with a resistance training exercise where the handle is on a wire or cable connected to weights. The weights could be connected so as to pull the user's arm further around his or her body. Alternatively, the user after grasping the handle, and while in a rotated position, could pull the handle to lift the weights.

Figure 5:
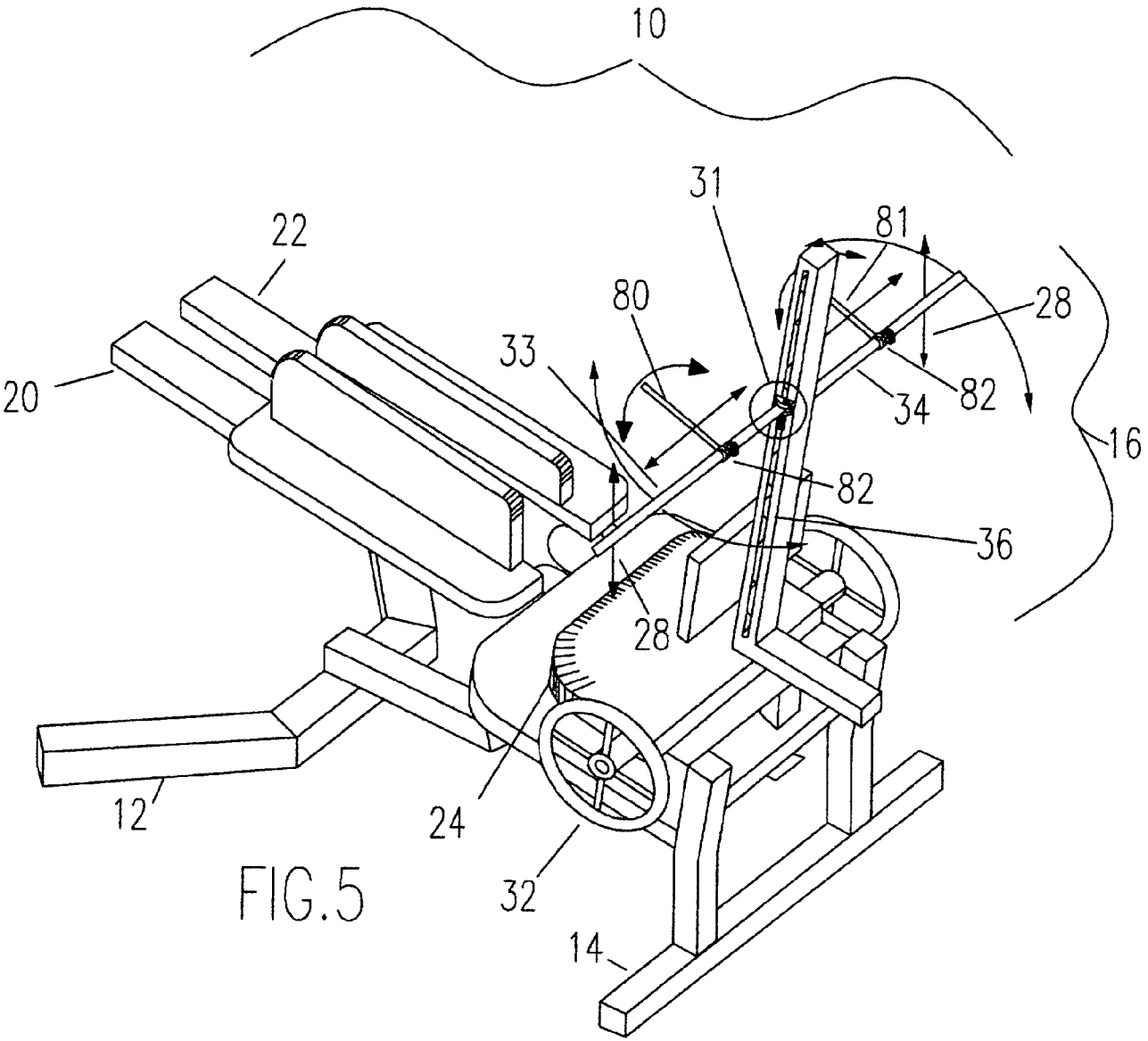
FIG. 5 is an isometric view of the stretching machine with an alternate handle arrangement.

FIG. 5 shows an alternate embodiment of back, torso and arm stretching component 16. Handles 60 and 61 are adjustable by sliding them along support beams 33 and 34 and secured by knobs 62 and 63 at the base of handles 60 and 61, respectively.

Figure 6:
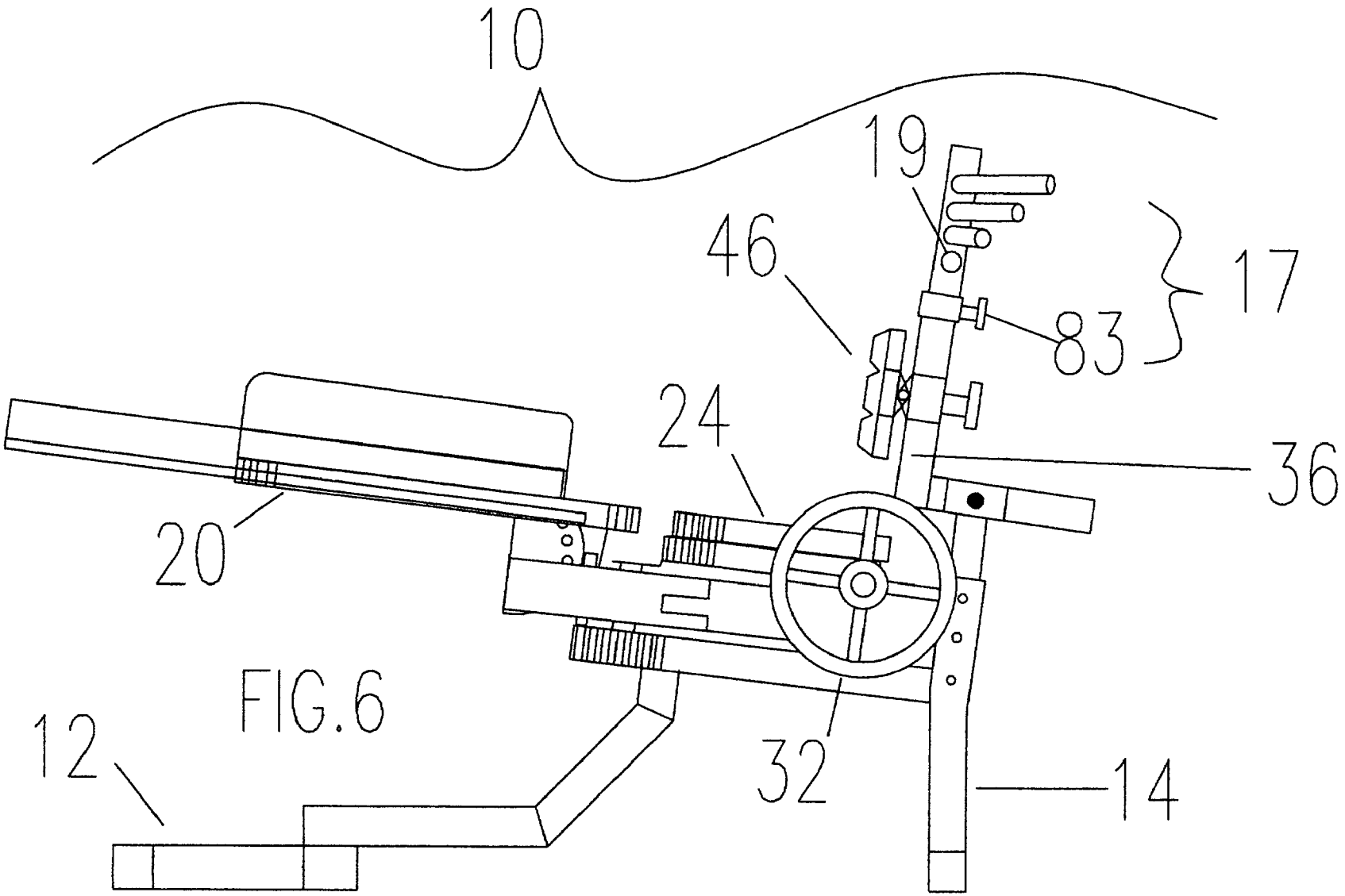
FIG. 6 is a side view of the stretching machine with an angularly graduated handle arrangement.
Figure 7:
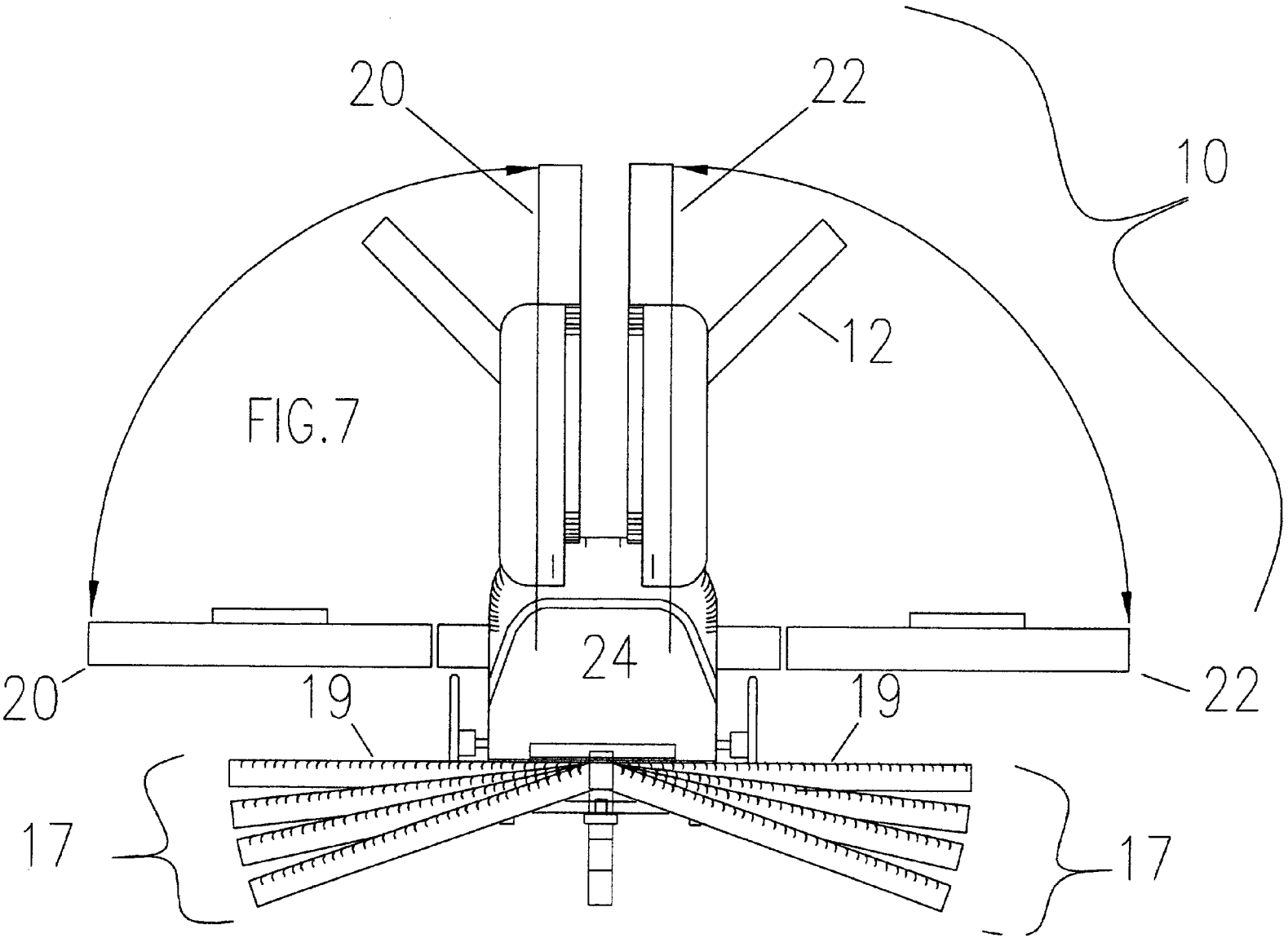
FIG. 7 is a top view of the stretching machine shown in FIG. 6 with an angularly graduated handle arrangement.

Now referring to FIG. 6 and FIG. 7, an alternate handle arrangement is shown by 17. Instead of a single, adjustable support beam, as in FIG. 1 and FIG. 5, four handles are arranged in a graduated array with each handle being more angled away from the user than the one below it. Using this arrangement, the user would start on the lowest bar 19 and work his way back to the furthest reachable bar. A numbering system for the bars would be employed to provide positive feedback as well as a indicator of progress.

Handle array 17 is preferably vertically adjustable by raising and lowering mechanism 83 which may secure handle array 17 by a retractable pin which allows handle array 17 to be raised and lowered for different users. FIG. 7 provides a top down view of the alternate embodiment pictured in FIG. 6.

Figure 8:
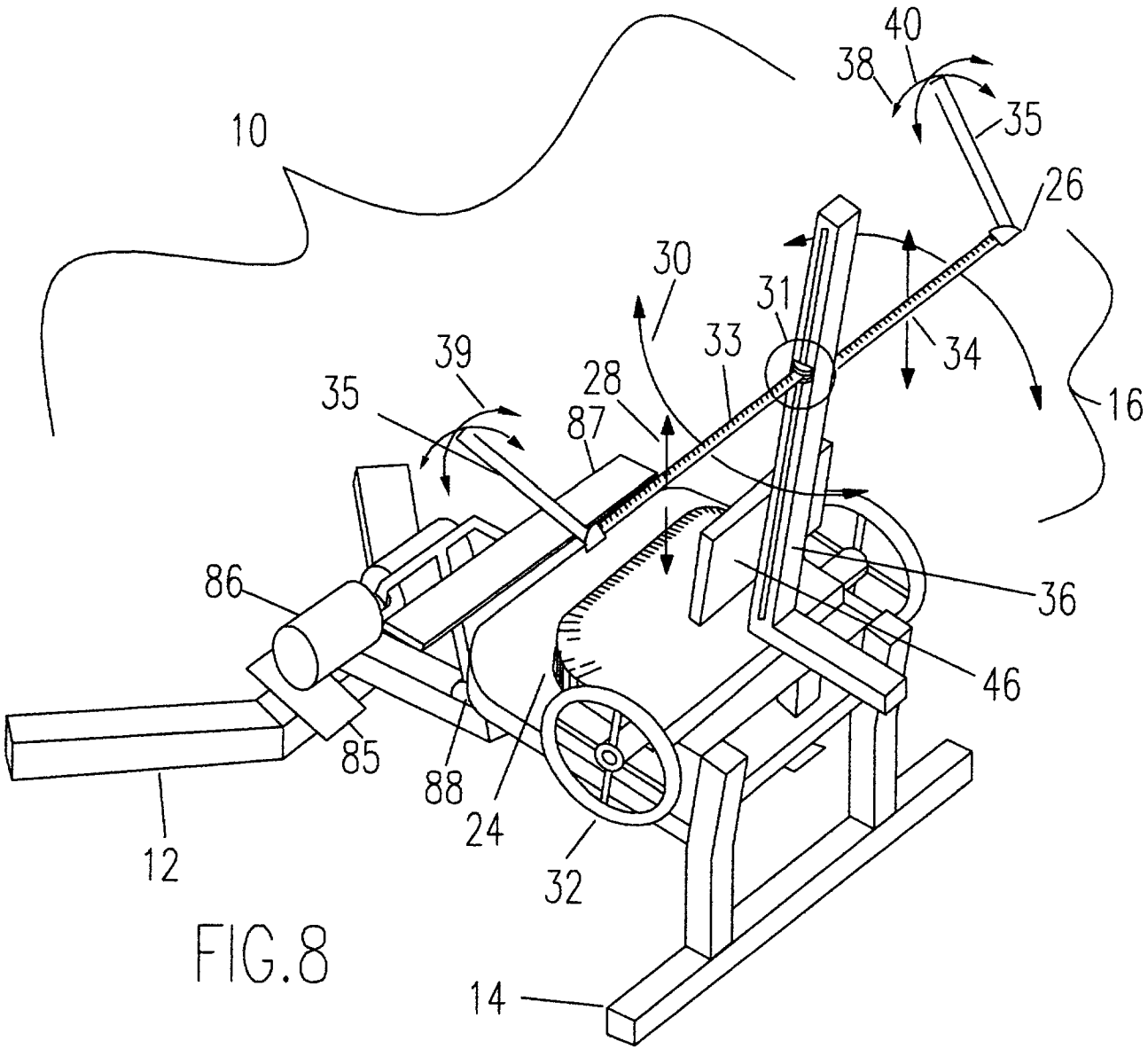
FIG. 8 is an isometric view of another embodiment of the stretching machine with a hip and pelvis securing system that locks the legs in place.

FIG. 8 shows an alternate method for securement of a user's hips and pelvis. The feet are placed on foot rests 85 with the user's legs under leg restrainers 86 and 88. Then, preferably using a hinge and ratchet mechanism 88, leg restrainers 86 and 87 are brought down closer to seat 24 so that the legs and the pelvis of the user are restricted from moving or rotating. This accomplishes the securement of the hips and pelvis, so back and arm stretching component 16 may then be used to stretch the torso or shoulders in the same manner as discussed in conjunction with FIG. 1 (it being understood that like numerals in the figures performing like functions).

Figure 9:
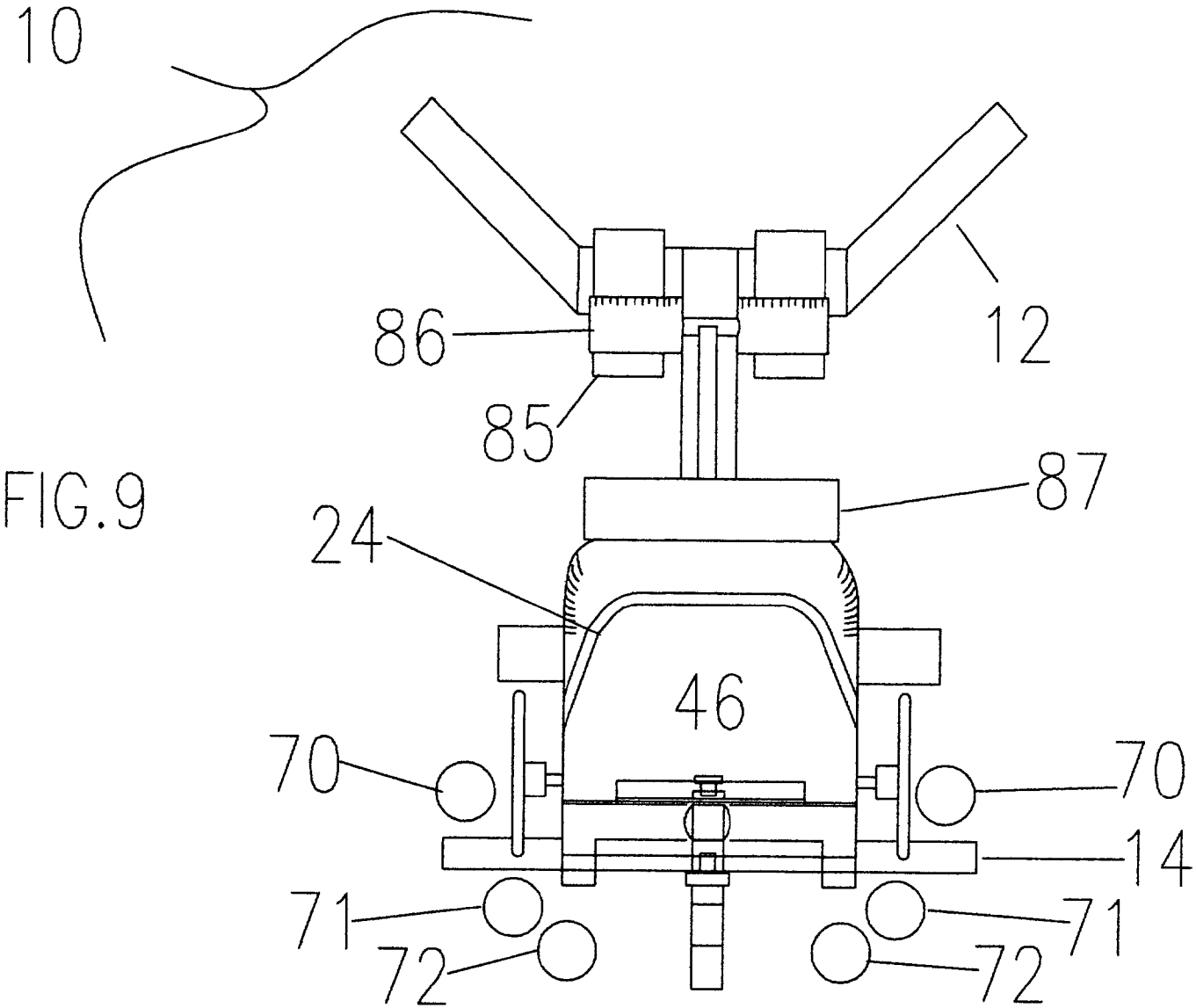
FIG. 9 is a top down view of the stretching machine with a hip and pelvis securing system that locks the legs in place shown in FIG. 8, as well as three vertical poles on each side of the device.

FIG. 9 shows the alternate method for securement of a user's hips and pelvis, as shown in FIG. 8, as well as an alternate arrangement of handles. The handles 70, 71 and 72 are vertical poles that are situated three to a side and numbered so that the user may track his progress in the rotational stretch. It being understood that more or less vertical poles may be used in conjunction with the present invention. In operation, a user would, while his hips or secured, rotate his or shoulders about the spine and grasp one of the handles 70, 71 and 72 on the opposite side of his or her body. Because the handles 70, 71 and 72 are vertical, user's of virtually any height can be accommodated (i.e., they can grasp the handles 70, 71, and 72 at any vertical height). In addition, the user may exercise different muscle groups while reaching to relatively higher or lower heights on the handles 70, 71 or 72. As discussed previously, once one of the handles 70, 71 or 72 is grasped, the user will hold the stretch as long as comfortable. Alternatively, after grasping the handle 70, 71 or 72, the user may pull on the handle to enhance the torso stretch.

Figure 10:
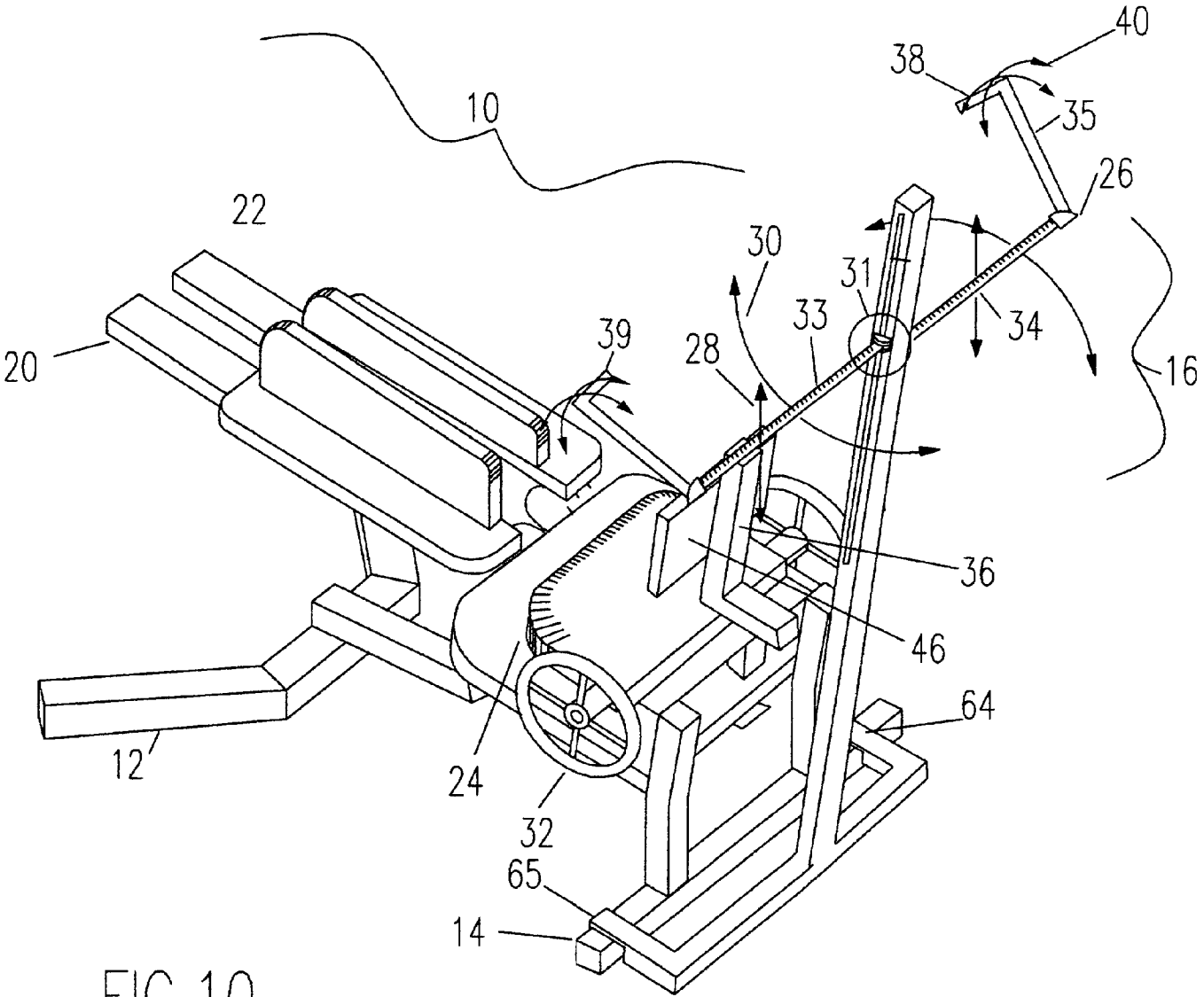
FIG. 10 is an isometric view of one embodiment of the stretching machine with a detachable grip and handle support structure.

FIG. 10 shows an alternate embodiment of exercise machine 10 where the handle array is independent from the waist securing portion. Preverably, the handle array could be attached to the machine by clamps 64 and 65 at the rear support 14 so that the back, torso and arm stretching component 16 may be stable during the stretching exercise. The embodiment shown in FIG. 10 uses legs decks 20 and 22 to secure the hips and the pelvis during the stretching exercise. This embodiment illustrates how the back and arm stretching component 16 may be added to any existing hip and pelvis locking device. Hence, gymnasiums and physical therapy or rehabilitation centers might utilize the back, torso, and arm stretching component 16 on an existing machine as a retrofit, thus minimizing floor space and other requirements for the stretch therapy apparatus described herein.

Figure 11:
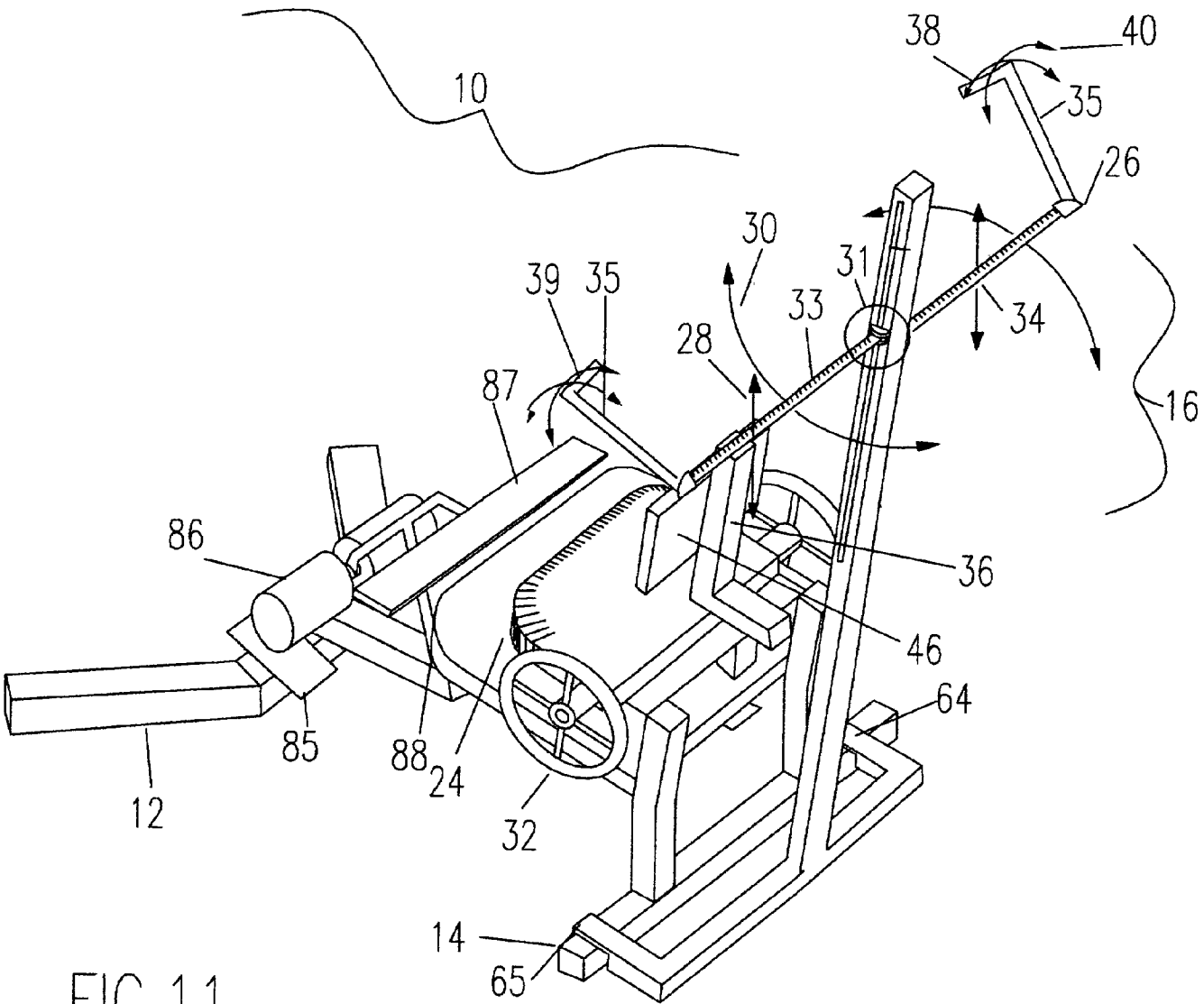
FIG. 11 is an isometric view of another embodiment of the stretching machine with a detachable grip and handle support structure on the machine with a hip and pelvis securing system that locks the legs in place.

FIG. 11 describes a similar detachable handle arrangement 16 as in FIG. 10 but with hips and pelvis securement method described in FIG. 8.

Figure 12:
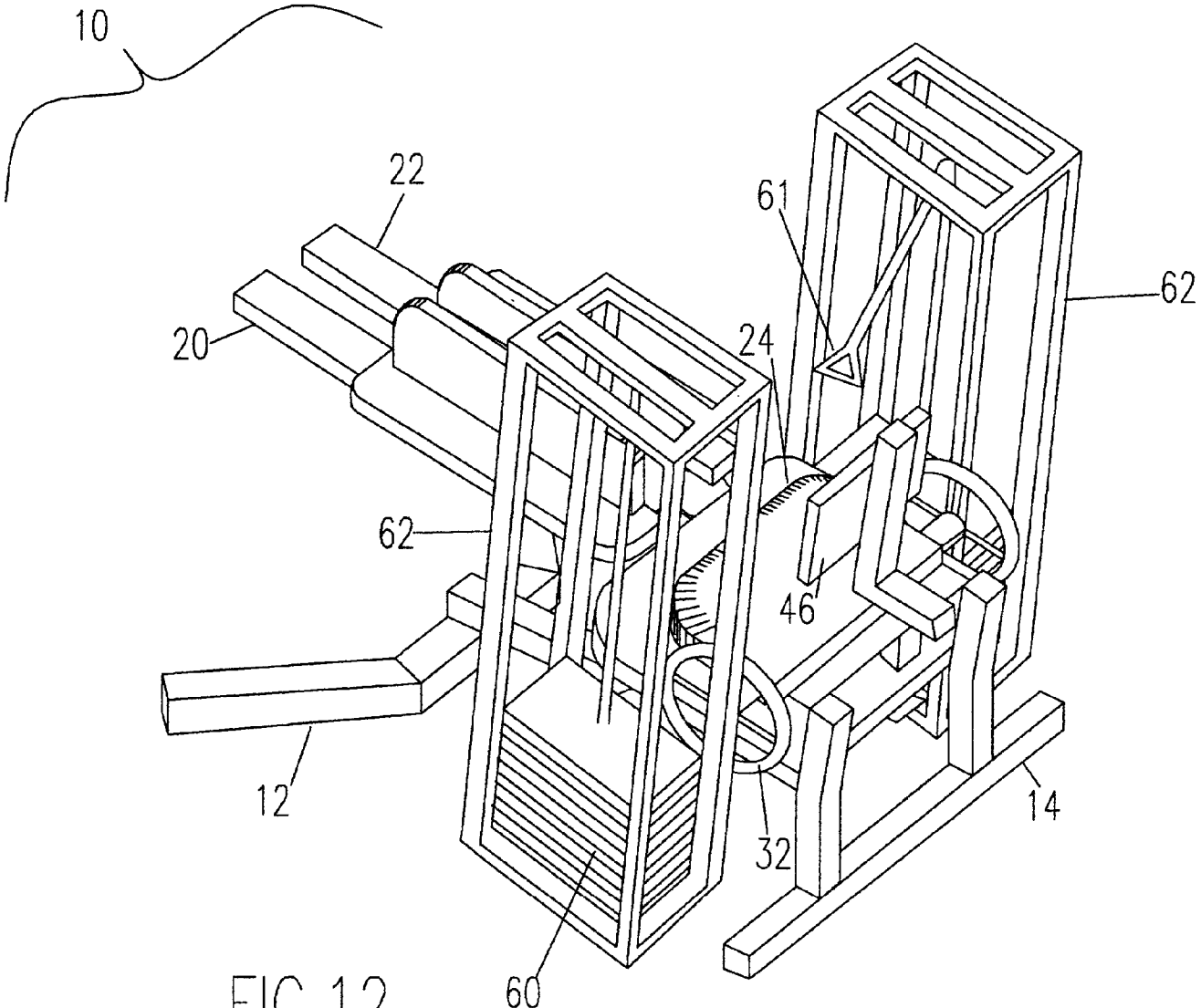
FIG. 12 is an isometric view of one embodiment of the stretching machine of this invention which is used in conjunction with resistance training elements.

FIG. 12 shows an alternate embodiment of the invention that uses weight stacks 60 to induce rotation of the torso. One the hips are secured by leg decks 22 and 20 or by a similar method (hip securement of FIG. 8), grip 61 is grasped by the hand on the opposite side of the body and pulled toward the center, raising the weights 60. Then the user may relax his muscles and have his torso rotated in an assisted stretch. The stretch may then be held for a period of time.

While the invention has been described in terms of its preferred embodiments, those of skill in the art will recognize that the invention can be practiced with considerable variation within the spirit and scope of the appended claims.

I claim:

1. A stretching apparatus, comprising:

a seat having a front side, back side, left side and right side;

a means for restraining movement of a user's hips while the user is seated in said seat; and at least a pair of grips wherein a first grip is positioned at a left side of said seat and a second grip is positioned at a right side of said seat, wherein each of said pair of said grips is positioned behind a plane passing through said back side of said seat, wherein said restraining means prevents the user from moving the hips while moving an arm to hold one of said grips.

2. The stretching apparatus of claim 1 wherein each of said pair of grips is a vertical pole which parallels a z-axis passing through said seat.

3. The stretching apparatus of claim 1 wherein each of said pair of grips is connected to a wire or cable.

4. The stretching apparatus of claim 3 wherein said wire or cable is connected to a moveable mass.

5. The stretching apparatus of claim 1 wherein each of said pair of grips is connected to a support positioned behind said back side of said seat.

6. The stretching apparatus of claim 5 wherein said support is connected to said seat.

7. The stretching apparatus of claim 1 further comprising a means for adjusting a height of said grips above said seat.

8. The stretching apparatus of claim 7 wherein said means for adjusting includes a support member for supporting said grips and a means for moving said grips up and down said support member and for holding said grips at a desired height on said support member.

9. The stretching apparatus of claim 1 further comprising a means for adjusting a location of said grips relative to said left and right sides of said seat.

10. The stretching apparatus of claim 9 wherein said means for adjusting includes a support member for supporting said grips and a means for pivoting said grips on said support member and holding said grips at a desired pivoted location.

11. The stretching apparatus of claim 10 wherein said means for pivoting is positioned on a vertical portion of said support member.

12. The stretching apparatus of claim 10 wherein said means for pivoting is positioned on a horizontal portion of said support member.

13. The stretching apparatus of claim 10 wherein said means for pivoting includes a ratchet mechanism.

14. The stretching apparatus of claim 1 wherein said means for restraining movement of a user's hips comprises a pair of leg supports which move along an arcuate path from a front side of said seat to a left and a right side of said seat.

15. The stretching apparatus of claim 14 further comprising a means for holding said leg supports at said left side and said right side of seat by up to approximately 1800° apart.

16. The stretching apparatus of claim 1 wherein said means for restraining movement of a user's hips comprises a seat back positioned on a back side of said seat, and a means for gripping a user's legs so as to firmly hold a user's back against said seat back.

17. The stretching apparatus of claim 1 wherein each of said pair of grips is a vertical pole which parallels a z-axis passing through said seat.

18. The stretching apparatus of claim 1 wherein each of said pair of grips is connected to a wire or cable.

19. The stretching apparatus of claim 18 wherein said wire or cable is connected to a moveable mass.

20. A stretching apparatus, comprising:

a seat having a front side, back side, left side and right side;

a means for restraining movement of a user's hips while the user is seated in said seat; and at least a pair of grips wherein a first grip is positioned at a left side of said seat and a second grip is positioned at a right side of said seat, wherein each of said pair of grips is connected to a support positioned behind said back side of said seat, wherein said restraining means prevents the user from moving the hips while moving an arm to hold one of said grips.

21. The stretching apparatus of claim 20 wherein said support is connected to said seat.

22. The stretching apparatus of claim 1 further comprising a means for adjusting a height of said grips above said seat.

23. The stretching apparatus of claim 22 wherein said means for adjusting includes a support member for supporting said grips and a means for moving said grips up and down said support member and for holding said grips at a desired height on said support member.

24. A stretching apparatus comprising:

a seat having a front side, back side, left side and right side;

a means for restraining movement of a user's hips while the user is seated in said seat;

at least a pair of grips wherein a first grip is positioned at a left side of said seat and a second grip is positioned at a right side of said seat; and a means for adjusting a location of said grips relative to said left and right sides of said seat, wherein said restraining means prevents the user from moving the hips while moving an arm to hold one of said grips.

25. The stretching apparatus of claim 24 wherein said means for adjusting includes a support member for supporting said grips and a means for pivoting said grips on said support member and holding said grips at a desired pivoted location.

26. The stretching apparatus of claim 25 wherein said means for pivoting is positioned on a vertical portion of said support member.

27. The stretching apparatus of claim 25 wherein said means for pivoting is positioned on a horizontal portion of said support member.

28. The stretching apparatus of claim 25 wherein said means for pivoting includes a ratchet mechanism.

29. The stretching apparatus of claim 1 wherein said means for restraining movement of a user's hips comprises a pair of leg supports which move along an arcuate path from a front side of said seat to a left and a right side of said seat.

30. The stretching apparatus of claim 29 further comprising a means for holding said leg supports at said left side and said right side of seat by up to approximately 180° apart.

31. The stretching apparatus of claim 1 wherein said means for restraining movement of a user's hips comprises a seat back positioned on a back side of said seat, and a means for gripping a user's legs so as to firmly hold a user's back against said seat back.

32. The stretching apparatus of claim 1 wherein said at least a pair of grips includes a plurality of pairs of grips wherein a first grip and a second grip of each pair of grips is respectively positioned at said left and right side of said seat.

33. The stretching apparatus of claim 32 wherein said each pair of grips is positioned at a different angular location with respect to a back side of said seat.

34. The stretching apparatus of claim 33 wherein each pair of grips is positioned at a different height relative to said seat.

35. The stretching apparatus of claim 32 wherein each of said plurality of pairs of grips is comprised of two vertical poles.

36. The stretching apparatus of claim 32 wherein each of said plurality of pairs of grips is connected to a support member positioned at a back side of said seat.

37. The stretching apparatus of claim 36 wherein said support member is connected to said seat.

38. The stretching apparatus of claim 1 wherein each of said pair of grips is moveable vertically in a plane parallel to a z-axis passing through said seat.

* * * * *